United States Patent [19]

Bunke

[11] Patent Number: 4,811,504

[45] Date of Patent: Mar. 14, 1989

[54] WALK EASE SKI BOOT SOLES

[76] Inventor: Clinton R. Bunke, 103 S. Towanda - Ste. 7, Normal, Ill. 61761

[21] Appl. No.: 149,682

[22] Filed: Jan. 28, 1988

[51] Int. Cl.[4] ..... A43B 5/00; A43B 13/00

[52] U.S. Cl. ..... 36/132; 36/7.5; 36/25 R

[58] Field of Search ..... 36/7.5, 73, 7.6, 132, 36/117, 25 R, 32 R; 12/120.5; 128/83.5, 581

[56] References Cited

U.S. PATENT DOCUMENTS

| | | | |
|---|---|---|---|
| 3,665,620 | 5/1972 | St. Clair | 36/7.5 |
| 3,965,586 | 6/1976 | Roosli | 36/7.3 |
| 3,971,144 | 7/1976 | Brugger-Stuker | 36/117 X |
| 4,005,704 | 2/1977 | Stohr et al. | 128/83.5 |
| 4,156,316 | 5/1979 | DeFever | 36/132 |
| 4,160,301 | 7/1979 | Woolley | 36/132 X |
| 4,199,880 | 4/1980 | Frey | 36/132 |
| 4,228,602 | 10/1980 | Groves | 36/132 |
| 4,286,397 | 1/1981 | Booty | 36/132 |
| 4,294,025 | 10/1981 | Keller | 36/132 |
| 4,299,037 | 11/1981 | Carey | 36/7.6 |
| 4,446,856 | 5/1984 | Jordan | 128/83.5 X |
| 4,461,104 | 7/1984 | Calkin et al. | 36/132 |
| 4,505,057 | 3/1985 | Kiester | 36/117 |
| 4,542,599 | 9/1985 | Annovi | 36/117 |
| 4,570,363 | 2/1986 | Annovi | 36/117 |
| 4,619,059 | 10/1986 | Koniuk | 36/132 |
| 4,722,144 | 2/1988 | Beeri | 36/117 |

FOREIGN PATENT DOCUMENTS

| | | | |
|---|---|---|---|
| 2363131 | 6/1975 | Fed. Rep. of Germany | 36/132 |
| 2617257 | 1/1977 | Fed. Rep. of Germany | 36/132 |
| 2612257 | 9/1977 | Fed. Rep. of Germany | 36/132 |
| 2746052 | 4/1979 | Fed. Rep. of Germany | 36/132 |
| 2827410 | 1/1980 | Fed. Rep. of Germany | 128/83.5 |
| 573729 | 3/1976 | Switzerland | 36/132 |
| 588832 | 6/1977 | Switzerland | 36/132 |
| 1490219 | 10/1977 | United Kingdom | 36/32 R |

*Primary Examiner*—James Kee Chi

*Attorney, Agent, or Firm*—John C. Cooper, III; C. Thomas Sylke; Fred Wiviott

[57] ABSTRACT

A sole or plantar surface for footwear which may be incorporated in a walking appliance or attachment for conventional ski boots, and wherein the footwear has been deliberately configured to retain a foot in a substantially rigid and inflexible manner which interferes with a normal walking gait. The surface configuration facilitates walking by including at least one roll point area spaced rearwardly from the forward end. The one roll point area lies in a plane angularly disposed relative to the longitudinal axis of the plantar surface and in a direction towards the medial surface of the footwear.

33 Claims, 6 Drawing Sheets

WALK EASE SKI BOOT SOLES

BACKGROUND OF THE INVENTION

1. Field of the Invention

The present invention relates generally to walking appliances. The preferred embodiment relates to sole attachments for ski boots, and more particularly to attachments designed to increase the safety and comfort of the skier when walking in the ski boots, e.g. in walking to and from the ski slopes. Still more specifically, the technical advance of the present invention relates to such attachments which have been designed taking into account anatomical correctness, kinetic proportionality and the roll point design concepts described later herein.

2. Description of the Prior Art

Modern ski boots have been designed with skiing performance as the number one design criterion. While some efforts have been made, within the ski boot to itself, to increase skier comfort, one major design element of current ski boots makes walking in the boots extremely uncomfortable and dangerous. That factor is the forward cant which locks the lower leg and ankle in a forwardly inclined position, typically approximately 20° off the vertical.

Anyone who is at all familiar with skiing would immediately recognize that the forward cant creates a very clumsy situation when the boot is not attached to the ski itself and when the skier is walking to and from the slopes, is taking a rest or food break, etc. Because the ankle is locked, the normal ski boot walking techniques are to either plant the foot solidly and at one instant bend the body and upper portion of the leg to accommodate such an awkward position. Alternately, some skiers will plant the heel of the ski boot first and then "slap" the remainder of the sole down into contact with the walking surface. In either event, the movements are unnatural and create stresses and/or opportunities for stresses which could quickly lead to skier injury in the event the boot were to slip or the skier were to fall.

Many skiers attempt to overcome these problems by loosening their ski boots when not skiing, but that act creates additional opportunities for dangerous injuries, because the support provided by the boot itself is not present when the boot is loosened. Moreover, the wobbly nature of walking which must be employed if the boots are loosened creates an opportunity for both lateral and longitudinal slippage.

Those familiar with skiing will also recognize that the types of walking difficulties discussed above are encountered even when the surface on which the skier walks is relatively flat and non-slippery (for example in a carpeted ski lounge or on flat snow covered terrain). They are even more awkward and dangerous when a skier tries to manipulate stairs, steep hills or icy surfaces, places where potentially injurious stresses on ligaments or joints in the hip and lower spine can be created.

While the problems discussed previously in this section of the specification have been recognized for a number of years, there are no commercially available devices to overcome the problems. The present inventor is aware that ski sole protectors which are claimed to improve traction of the ski boots are being sold. For example, a ski boot appliance for "Improved Traction And Wear Protection" is described in Carey's U.S. Pat. No. 4,299,037, issued Nov. 10, 1981. While the device has and is being commercially sold, it does not accommodate in any manner for the forward cant of modern ski boots. Rather the device is concerned principally with protection of the bottom of the ski boot sole and improving traction by providing a number of studs in a tread design on the bottom surface. Straps are provided at the toe and heel portion for releasably connecting the appliance to the sole and heel of a ski boot.

Other techniques have also been suggested, including using a different type of ski boot having a curved bottom and a rear binding which is elevated to provide the desired degree of cant for skiing. This device is described in U.S. Pat. No. 4,505,057 issued Mar. 19, 1985 to Kiester and entitled "Ski Boot Sole Extension". The bottom provides a rolling action for walking, with the thickest part of the sole being located beneath the arch portion of the boot. A description of the anatomical considerations relevant the design of this device is provided at Columns 1 and 2 of the patent.

Another technique designed to provide a boot which, in its walking position, keeps the leg in a vertical position is described in U.S. Pat. No. 4,542,599 issued Sept. 24, 1985 to Annovi entitled "Ski Boot With A Normalized Sole". In this device, the boot is comprised of two sections, a first foot encasing section in which the foot is maintained in a normal vertical position. A second section of the boot is designed to be attached to the ski and includes an elevated rear surface. When the portions are combined, a forward cant is accomplished. This design provides a safer and more comfortable boot for walking, but requires a specific, new overall design concept which would not be useful at all on existing boots. Moreover, the engagement of the two portions of the boot would appear to be complicated in situations where snow would enter the corrugated portions on the lower portion and the tread of the boot itself. A related patent issued to the same inventor and disclosing the same concept is described in U.S. Pat. No. 4,570,363 issued Feb. 18, 1986.

Devices which include a sole attachment for ski boots and which provide a generally rocking-type movement when the skier walks in boots with the soles attached include those described by Keller in U.S. Pat. No. 4,294,025 issued Oct.13, 1981 and entitled "Sole Attachment For Facilitating Walking38 ; U.S. Pat. No. 4,156,316 issued May 29, 1979 to DeFever and entitled "Ski Boot Attachment"; a "Ski Boot Cover" described by Roosli in his U.S. Pat. No. 3,965,586 issued June 29, 1976; U.S. Pat. No. 3,971,144 issued July 27, 1976 to Brugger-Stuker for "Combination Ski Boot And Walking Sole And Connection Means For Such Combination"; Frey's "Combination Ski Boot Walker And Carrier" described in U.S. Pat. No. 4,199,880 issued April 29, 1980; and U.S. Pat. No. 3,665,620 issued May 30, 1972 to St. Clair for "Walking Method And Apparatus For Ski Boots". The latter device includes a walking member releasably attached at the central portion of the sole of the ski boot. In side view, the attachment resembles a block and the inventor describes how the extension below the surface of the boot can provide a rocking motion and improved safety and comfort for the wearer.

Another approach to the aforementioned problems of walking in ski boots is described in Koniuk's "Boot Accessory" U.S. Pat. No. 4,619,059 issued Oct. 28, 1986. A boot sole is provided with an attachment means and a generally convex lower surface to provide a more comfortable rocking-type action. The inner portion of the ski boot sole includes a deformable material so that the user is able to walk on irregular or inclined surfaces, such as stairs. The deformable material (actually a material which is more deformable than the material from which the sole itself is constructed), is provided in a core like rectangular body extending longitudinally in the ski sole.

Four additional United States Patents also address the problems discussed above. These will be described in slightly greater detail in that, at first glance, the walking attachments appear to be somewhat similar in configuration to that shown in the present invention. None of these walking attachments appear to take into account anatomical correctness, kinectic proportionality nor "roll point" aspects taught herein. In Calkin, et al, U.S. Pat. No. 4,461,104 issued July 24, 1984 for "Removable Walking Attachment For Ski Boots" the boot is provided with a removable, curved sole having heel and toe straps including turnbuckles so that the walking attachments may be used with a variety of sizes of boots. The thickest portion of the sole is located under the ball of the foot to allow the foot to rock rearward, thus enabling the leg to be straightened at the knee for normal walking. The deficiencies of using a single sized device for different ski boots and the particular deficiencies of the configuration of the Calkin, et al device will become apparent after the description of the preferred embodiment of the present invention is read and understood. Calkin, et al, like many of the other patents, provides a tread on the lower surface of the attachment for increasing traction between the ski boot attachment and the surface.

Another "Ski Boot Attachment" is described in the Groves U.S. Pat. No. 4,228,602 issued Oct. 21, 1980. In this device, a wire member is rotatably mounted at the rear of the attachment for coupling the rearward projection of a typical ski boot to the sole, and a spring loaded retractable clamp is used to secure the toe extension to the boot. In cross surface configuration, the attachment is generally convex, but it is slightly thicker at the forward part of the arch or the rearward portion of the ball part of the foot encased within the ski boot.

Yet a further device similar to the previously described patent is the "Ski Boot Walking Accessory" described by Booty in his U.S. Pat. No. 4,286,397 issued Sept. 1, 1981. This patent also includes a tread containing sole attachment having means for connecting the toe and heel extensions of the boot, and specifically an elongate elastically deformable cord which engages the heel portion of the boot. A plurality of stud-engaging slots are provided along the length of the sole to permit a range of adjustment of the effective length of the cord, thus permitting a single size attachment to be used with a variety of sizes of boots. As previously mentioned, the defects inherent in such a design concept will become apparent later in this specification.

Finally, with regard to United States patents, Woolley also discloses in "Combined Holder And Sole Accessory", U.S. Pat. No. 4,160,301 issued July 10, 1975 a combined holder and sole which has a convexly curved ground engaging surface. The curve is alleged to provide or simulate normal ambulatory movement and includes its thickest portion generally at the forward part of the arch, or beneath the ball of the foot. The device of this patent includes a rearward section which is extensible to allow the boot attachment to be used with a variety of sizes of ski boots. This device also includes a tread for improving traction.

As would be expected in the skiing art, the problems described about walking in ski boots have also been addressed by foreign inventors. For example, German Patent No. 27 46 052 also describes a ski boot attachment having a generally convex lower surface to improve walking conditions when a ski boot having a forward cant is used. Other foreign patents of interest include German Patent Nos. 26 17 257, 23 63 131, 26 12 257 and Swiss No. 588,832. Finally, another rocking-type device is disclosed in Swiss Patent No. 573,729. In this device, a central block portion is provided at the midpoint of the attachment and two extensions extend forwardly and rearwardly therefrom. The exensions are locked by deformable cords over the toe and heel of the boot so that the walking action takes place primarily on the block portion.

A most interesting aspect of studying the disclosures of the aforementioned patents is the fact that after reviewing currently available ski acessories, the only commercially available device is the traction device of Carey disclosed at the beginning of this section of the specification. The problems with which the present invention are concerned are so important to the well-being of the skiing community that it is not surprising that the art is crowded with overly simplistic and technically inadequate devices. Because one would expect a desirable solution to the problem to be an instant commercial success among the safety concious, it becomes apparent that the attempted solutions have, in fact, missed the basics required for either commercial or technical success.

SUMMARY OF THE INVENTION

The sole attachment of the present invention is intended to compensate for the "locked in" forward cant of the conventional ski boot. Although excellent for skiing activities the conventional boot design interferes with normal interaction of the pelvis, upper and lower leg, ankle and foot necessary to provide a normal walking gait. The present inventor had studied this problem in considerable detail and had determined that anatomical correctness, kinetic proportionality, lateral stability, roll points, vector field resultants and various combinations of the foregoing had been ignored, not only in prior art ski boot attachments, but in the design of other footwear as well. This conclusion was then confirmed by reference to the above-mentioned patents, orthopedic specialists and the technical literature.

The mechanics of the foot's action in different phases of its functional contact with the ground have been thoroughly discussed in the text, *The Human Foot* by Dudley J. Morton, Columbia University Press 1935. As Professor Morton set forth in Chapter XVI entitled, "The Mechanics Of The Foot In Walking", there are two major phases to be recognized.

> "One occurs during the first half of the foot's contact with the ground. It is characterized by the progressive assumption of the body weight by the foot, the maximum being reached when the body center is directly over the middle of the foot. Here this phase ends. The second major phase follows immediately, and is characterized by the propulsive effort. The first phase is essentially gravitational; the second is the leverage phase. In addition to these major phases, three minor ones may be identified in the walking step:

(1) a brief, nonweight-supporting period between the contacts of the heel and of the fore part of the foot with the ground;

(2) a momentary "standing phase" separating the two major ones; and (3) a phase of digital effort which follows and supplements the more important leverage action of the foot itself."

Thus, in evaluating a single step with a double stride from heel contact to heel contact of the same foot, after the right heel makes its contact, the unsupported fore part of the foot is quickly forced to the ground under the advance of body weight. From this point, the weight stresses are transmitted more and more heavily upon the foot until the maximum is reached at the brief moment when the weight center passes directly above the middle of the foot. This moment may be called a standing phase because here the entire weight of the body, except that portion which has been translated into momentum, is concentrated upon the one foot and distributed through it at the same ratio as instance It was recognized by the present inventor, and apparently ignored by others, that the foot actually moves medially (towards the center of the body) during the walking gait. During less forceful efforts of walking, the lateral metatarsal bones are most effective in redirecting the course of the lateral stresses towards the medial (inner) border of the foot, and towards the great toe. In effect, the normal walking gait can be analyzed and explained according to force field, vector and resultant concepts.

The distribution of weight pressure throughout the contact area of the foot during walking has been calculated as shown by the dotted path indicated in the plantar surface outline of FIG. 11, and known as the "path of resultants". It will be observed that the last phase of the foot step is limited to the propulsive effort of the toes, and begins when the metatarsal bones break their contact with the ground. During the previous phase, when the heel was being lifted and the ankle extended, the toes were forced into hyperextension in spite of the fact that contraction of their long flexor muscles was more active in contributing to the leverage of the foot. The dorsal movement of the toes, however, has the effect of increasing the tension of their muscles, and to such a degree that when the leverage effort of the foot against body weight has been completed, the subsequent toe flexion is strong enough to add a final elastic impetus to body movement which gives it smoothness and grace. At this point, the stresses have been swung towards the first metatarsal bone so completely that the most important digital effort is performed by the great toe. At this stage of the stride, the body's center of gravity has become so far advanced that the toes are not seriously involved in the vertical stresses of body weight. Their function is chiefly to impart the final push which carries the weight center beyond its perpendicular position above the opposite foot. But, note that the path of resultants shift the weight stress to the right as viewed in the dotted lines of FIG. 11.

The ski boot sole attachment of this invention provides a means of regaining the "path of resultants" which had been virtually eliminated by the very features built into a ski boot for improving skiing performance, contrary interaction of the foot components needed for achieving a normal walking gait. The combination of five roll points defined on the plantar surface of the attachment of this invention together with resultant compensating beveling of the sole surface achieve this result. Two of the roll points are located longitudinally spaced from one another and disposed at the extreme opposite ends of the plantar surface of the attachment. The third roll point is at the midpoint ("arch") of the plantar surface; the fourth roll point is at the frontal point of the heel and the fifth is at the frontal part of the plantar surface of the attachment and corresponding to the "ball" of the foot.

Thus, the extreme rearward roll point facilitates initial and natural contact with the walking surface. The heel roll point facilitates propulsion toward the centering of the body over its center of gravity. The mid arch roll point promotes balancing and transition over the body's center of gravity, whereas the roll point at the "ball" area, which is canted significantly towards the medial, facilitates the transition to the lift and weight transfer point. The extreme frontal roll point facilitates final weight transfer and release from the walking surface and emulates the action of the great toe.

DESCRIPTION OF THE DRAWINGS

The following is a brief description of the accompanying drawings.

DETAILED DESCRIPTION OF THE PREFERRED EMBODIMENT

Figure 1:
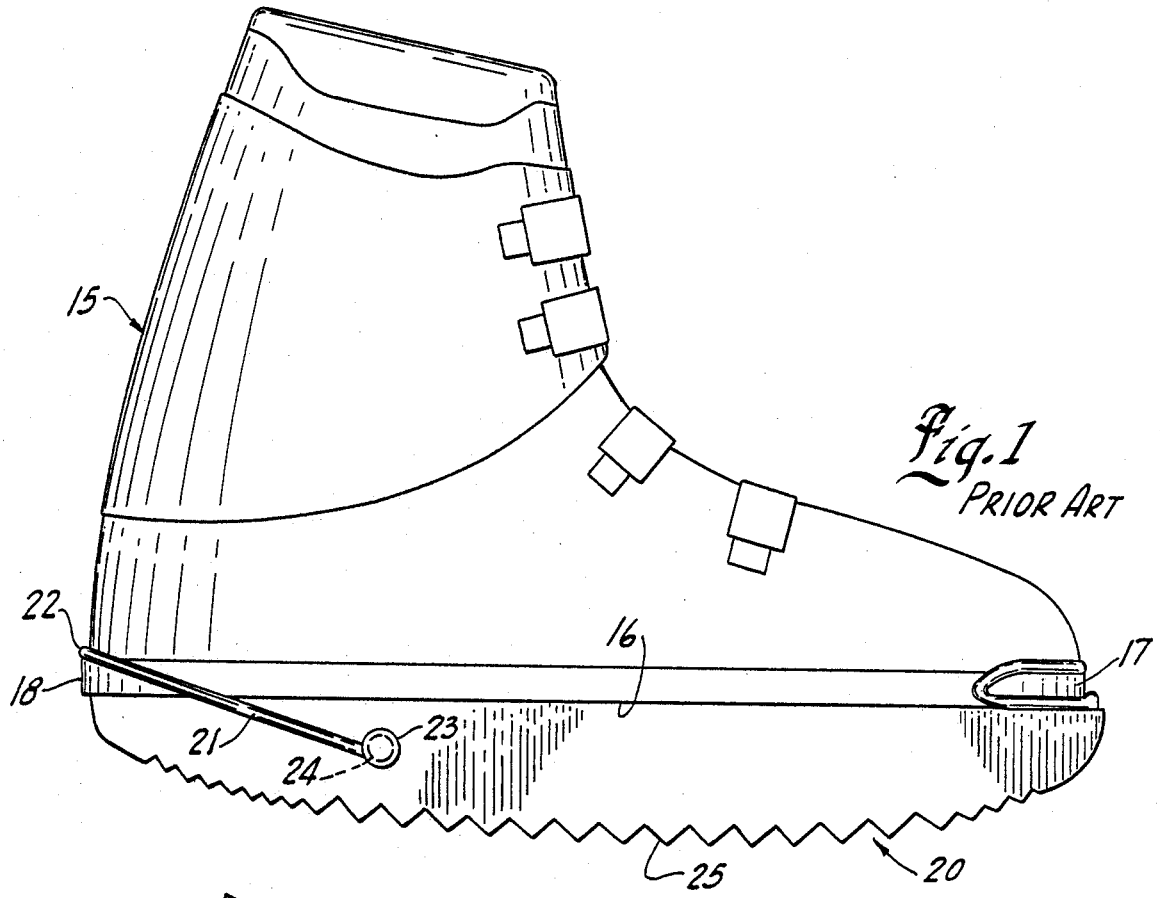
Fig. 1 PRIOR ART
FIG. 1 is a side elevational view of a conventional ski boot including a sole attachment of the prior art.

FIG. 1 illustrates a prior art sole attachment for conventional ski boots. The prior art attachment in this case presents a flat upper surface engagable with the relatively flat plantar or lower surface of the coventional ski boot.

The problem, as outlined above, of the conventional ski boot is the rigidity of the boot and the locking in of the lower limb to a fixed position approximately 15°–20° from the vertical to provide a desirable skiing position. The prior art construction of FIG. 1 attempts to rectify the problem and re-establish the necessary foot functions to provide a natural walking gait.

The prior art boot 15 of FIG. 1 is conventional and includes the usual relatively flat plantar surface or sole 16. The boot 15 has the usual toe and heel projections 17 and 18 which serve to removably and detachably connect the shoe or boot to a ski as is well understood by those skilled in the art. The sole 16 is relatively flat so as to engage upon a binding plate of a ski (not shown) and in general is of a design and material of relatively low frictional characteristics to allow proper relative movement between the boot and ski during, for example, a fall. In such case, the binding may rapidly and efficiently release the boot and minimize the possibility of injury to the skier. The prior art attachment 20 is fastened to the boot by means of a generally U-shaped clip 21 having its rearward bale portion 22 engaging the boot projection 18. The arms 23 of the clip 21 attached to an integrally formed projection member 24 at either side of the attachment 20, providing a pivotal attachment thereto. The lower or "plantar" surface 25 of the attachment 20 is provided with a series of transversely arranged "sawtooth-like" transversely disposed ridges for gripping the ground during walking.

At least on cursory examination, attachment 20 is not entirely unlike the attachment disclosed in the DeFever Pat. No. 4,156,316, wherein DeFever provides a "rocking" motion caused by the arcuate or convex configured central portion. DeFever emphasizes that the lower surface of the attachment converges toward the upper surface at both ends thereof. This design clearly does not attend to the technical considerations of anatomical correctness, kinetic proportionality, lateral stability, etc.

In contrast, the ski boot attachment member 30 of the present invention approaches the technical problems discussed above in an entirely new way. Attachment member 30 includes a sole or plantar surface configuration preferably molded from an elastomeric composition, such as a urethane foam. Obviously, the "sponginess" of the foam may be controlled by conventional practice known to those skilled in the art of resin molding. It is desirable, also, to reduce the height of the attachment 30 to a minimum height in order to enable the skier, while skiing, to transport a pair of attachments in a conventional "fanny pack", or other relatively thin container.

Figure 2:
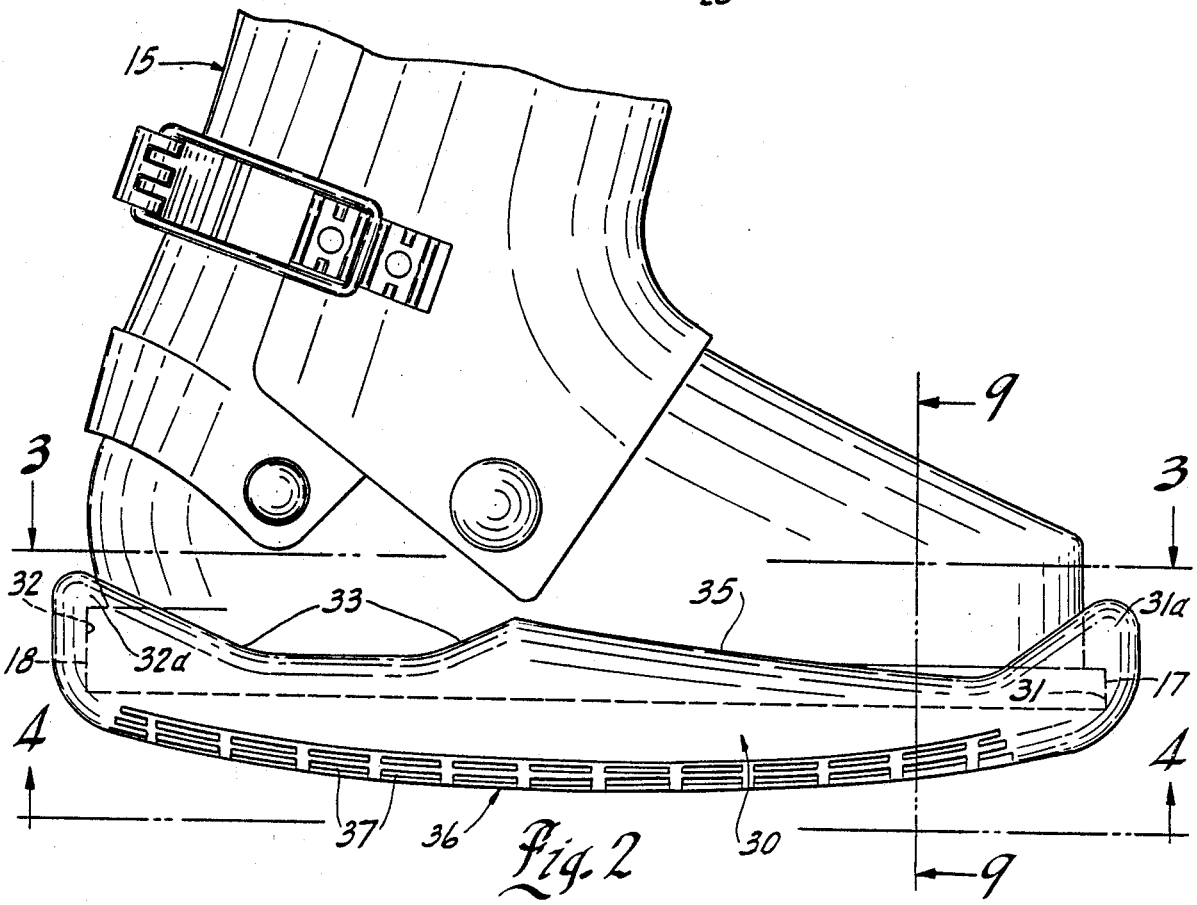
FIG. 2 is a side elevational view of a conventional modern ski boot with a sole attachment made in accordance with the teachings of the present invention.
Figure 2A:
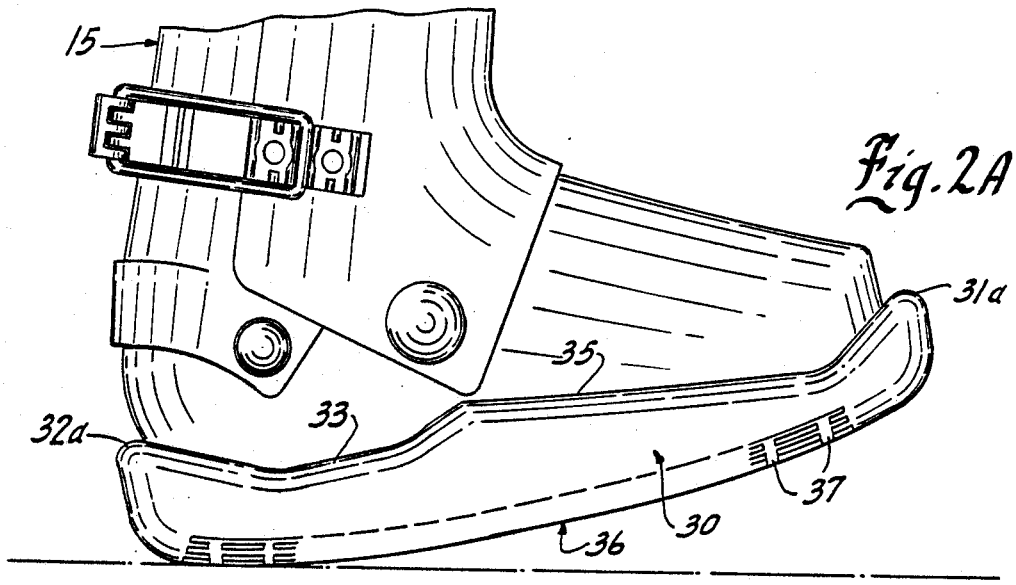
FIGS. 2A, 2B and 2C show the combination of FIG. 2 in three stages of the walking process.
Figure 2B:
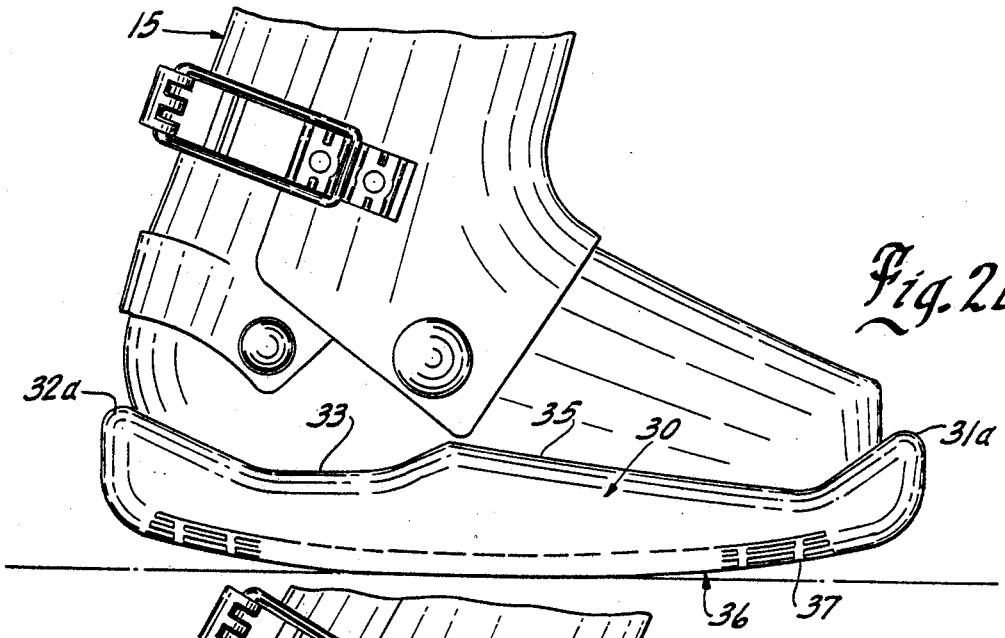
Figure 2C:
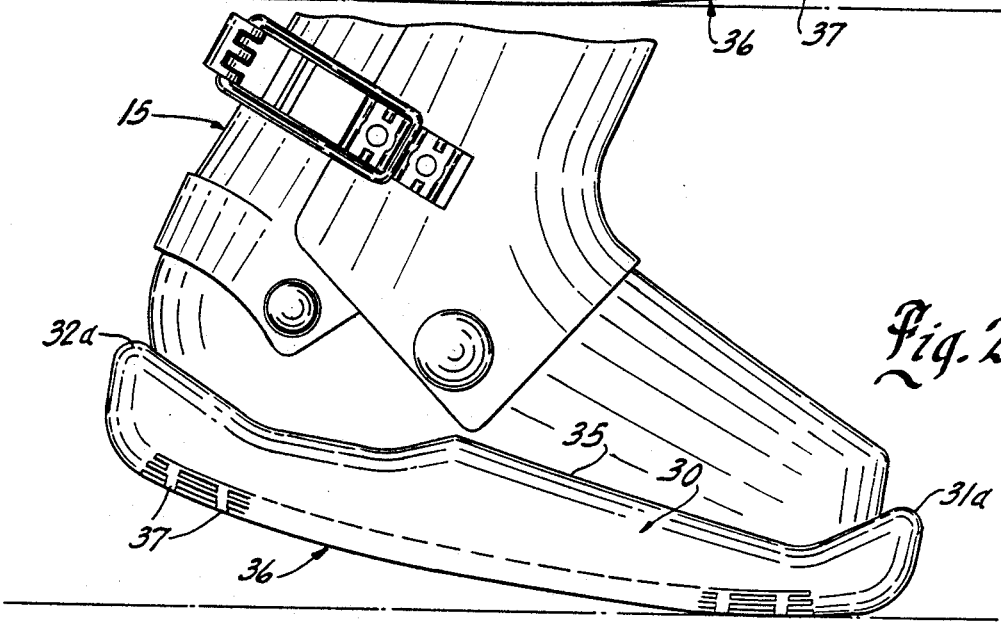

It will be observed from FIG. 2 that the preferred embodiment of the ski boot attachment 30 may take the form of a "boat-like" configuration molded of an elastomeric material. There is provided a forward recessed area 31 defining a retaining lip 31*a* engagable with the projection 17 of the boot 15. A rearward recessed area 32 defines a retaining lip 32*a* for engagement with the projection 18 of the ski boot 15. Recesses 31 and 32 are configured with relatively sharply defined marginal surfaces for tight engagement with the respective projections 17 and 18 of the boot 5. A portion 33 of each of the respective medial and lateral sidewalls 34 and 35 is relieved partially to permit ease in fitting the elastomeric attachment 30 to the boot 15 and to conform the uppermost portion of walls 34 and 35 to the boot 15 for improved aesthetic appeal and to enhance the lateral stability of the attachment when it is fitted to a boot. Finger grasping of the rearward surface will permit the elastomeric material to be stretched to engage or disengage the heel or rearward projection 18.

Figure 4:
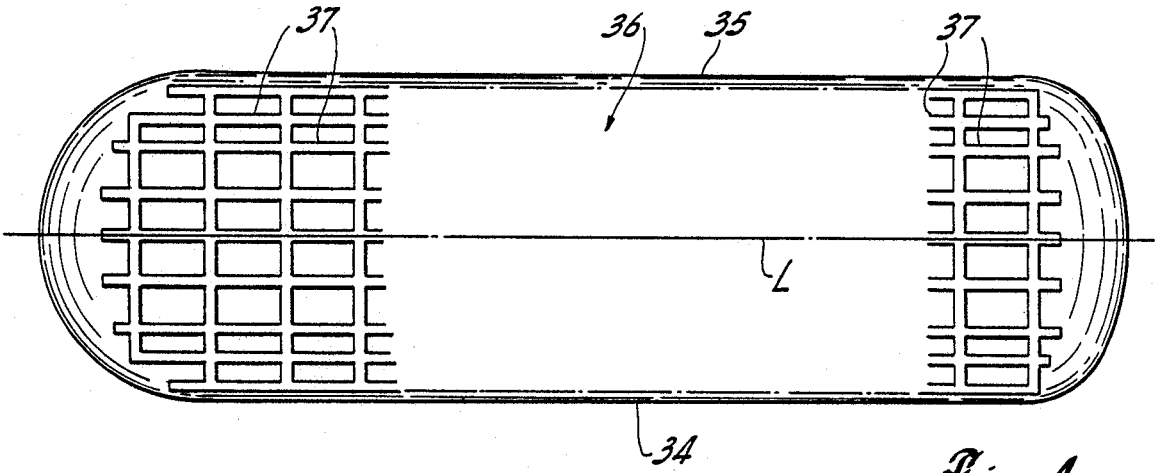
FIG. 4 is a bottom view of the sole attachment of the present invention taken along lines 4—4 of FIG. 2.
Figure 5:
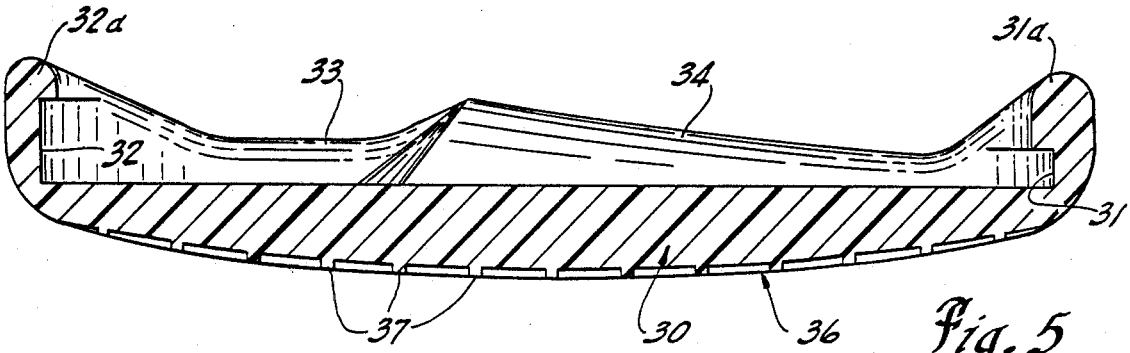
FIG. 5 is a longitudinal cross-section and view taken along lines 5—5 of FIG. 3.

As shown in the views of FIG. 2 and FIG. 4, the plantar or bottom surface 36 of the attachment 30 is perferably provided with treads 37 to minimize slipping on ice or snow. It is also preferred to configure the surface of the attachment 30 to permit the treads 37 to project at opposite sides slightly above the plantar surface 36 on the generally rounded sides 37*a* thereof, to provide additional protection to the person walking with the attachment 30 secured to the boot 15, especially from slippage in a lateral direction. A sharp contrast is then noted between this device and that shown in FIG. 1 where knife-like edges exist between the sides and the bottom of attachment 20.

Figure 11:
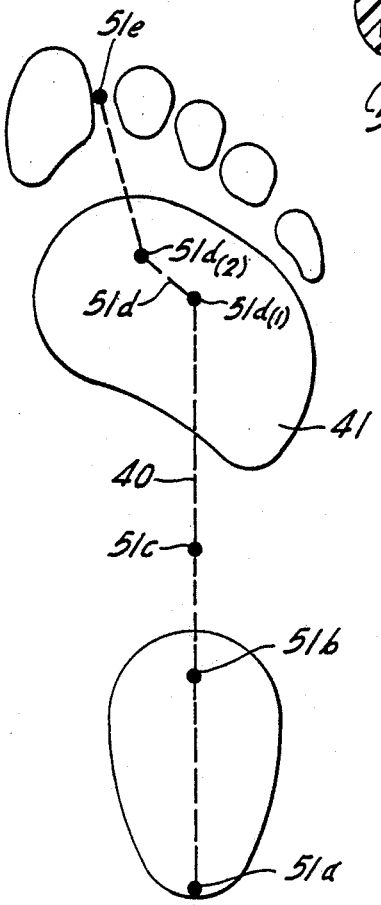
FIG. 11 is a diagrammatic view of the plantar surface of a human right foot illustrating the "path of resultants"

With particular reference to FIGS. 3, 6, 7, 8 and 11, it will be observed that the plantar surface 36 of the attachment 30 is further configured in a manner which will re-establish the desired "path of resultants" as exemplified by the dotted line or path 40 shown on the outline of the foot 41 of FIG. 11. A slight overall cant toward the medial body axis is provided along the length of attachment 30, accentuated at the forward part thereof. The angle of cant may vary from the vertical from about 3 degrees rearwardly of attachment 30 (see FIG. 9) to about 8 degrees (see FIG. 8) at the forward end (FIG. 9).

Figure 10:
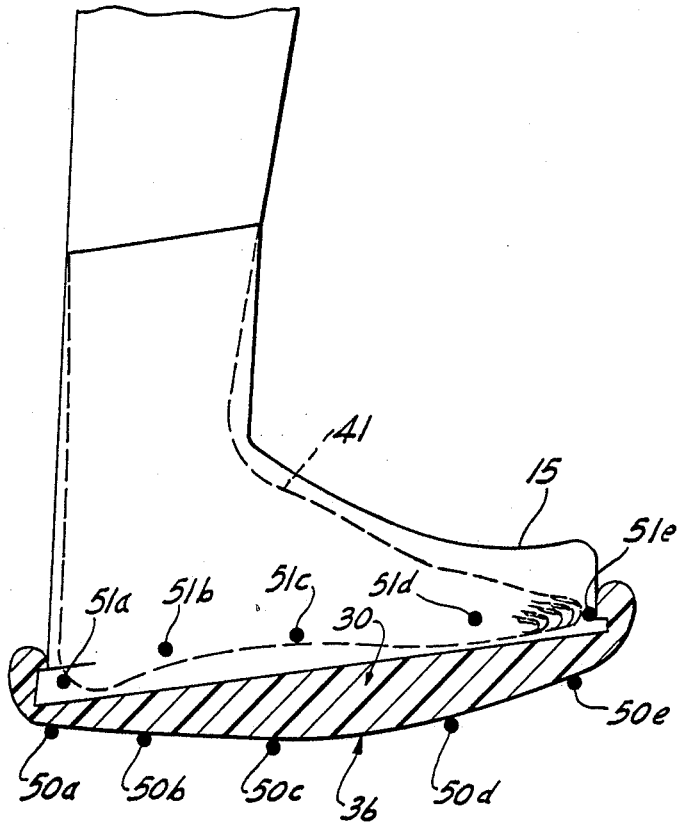
FIG. 10 is a side elevational view of lower extremity of a human leg fitted into a conventional ski boot and showing the sole attachment in cross-section and with the five roll points of the present invention shown schematically relative thereto.

With particular reference to FIGS. 10 and 11, the foot 41 is shown fitted into a boot 15 secured to the boot attachment 30 in accordance with the present invention. The preferred "roll points" or areas are indicated at 50*a*, 50*b*, 50*c*, 50*d* and 50*e* on plantar surface 36 of the attachment 30. The roll points, or areas, correspond to similar areas of the foot 41 identified at 51*a*, 51*b*, 51*c* 51*d* and 51*e*, respectively on FIG. 10. It will be apparent that the roll point or points 50*a*, 50*b*, 50*c* and 50*d* are located in respective planes lying substantially normal or perpendicular to the longitudinal axis L of the attachment 30 (see FIG. 4) and the linear portion of the dotted line path of resultants 40 of the foot 41 as disclosed in FIG. 11, and defined by points 51*a*–51*d*(1), inclusive. The roll point or area 50*e* deviates relative to the longitudinal axis to skew or cant the rigidly encased foot 41 towards the medial, as shown in the portion 51*a* of the diagram of FIG. 11 to emulate the mechanical action of the foot during a normal walking gait. Thus, the location of the roll points 50*a*–50*e* re-establish a "normalized" walking gait by securement of the attachment 30 to a conventional, relatively stiff ski boot 15 which has been designed and canted from the vertical to establish the desired position for skiing.

Figure 3:
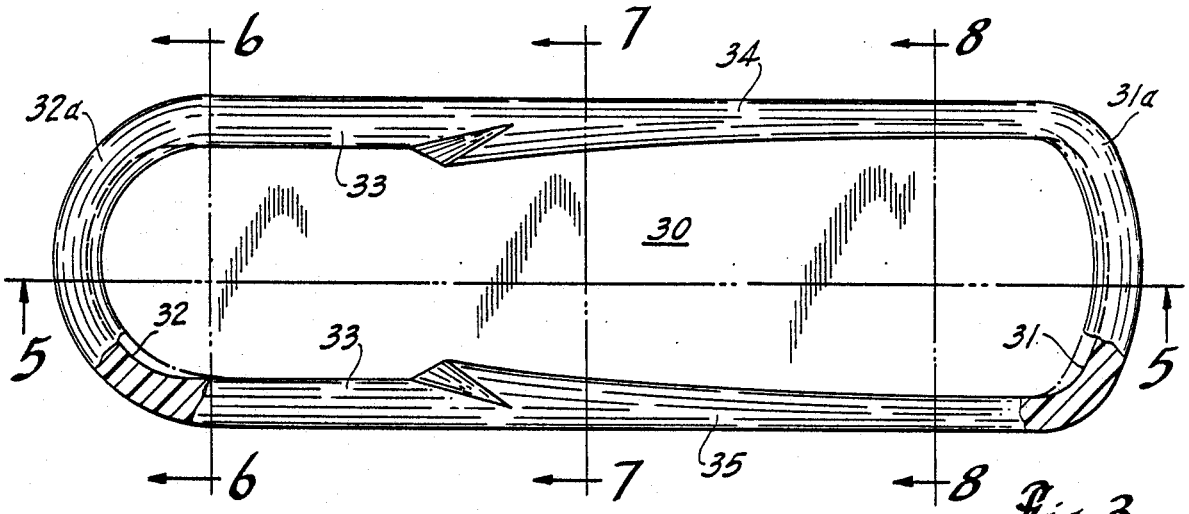
FIG. 3 is a top plan view of the sole attachment of this invention, and approximately the elevation taken along lines 3—3 of FIG. 2.
Figure 6:
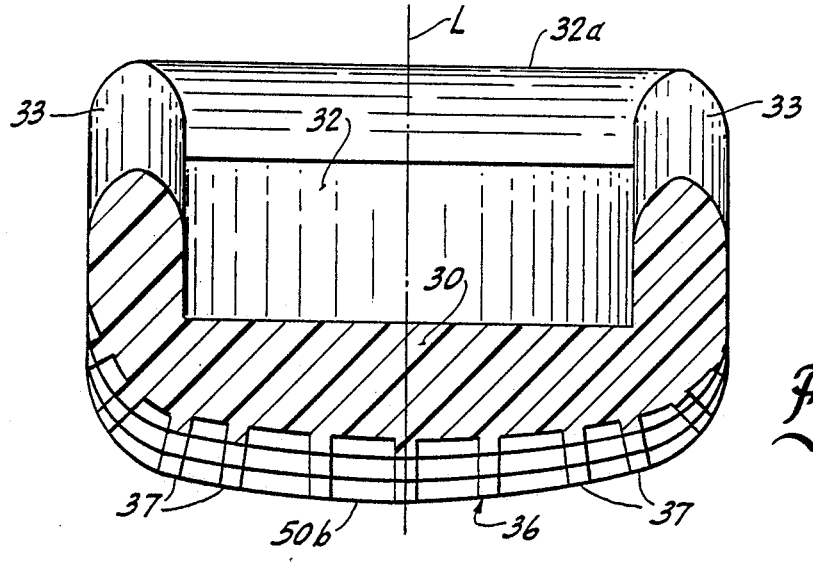
FIG. 6 is a cross-sectional view taken along lines 6—6 of FIG. 3.
Figure 7:
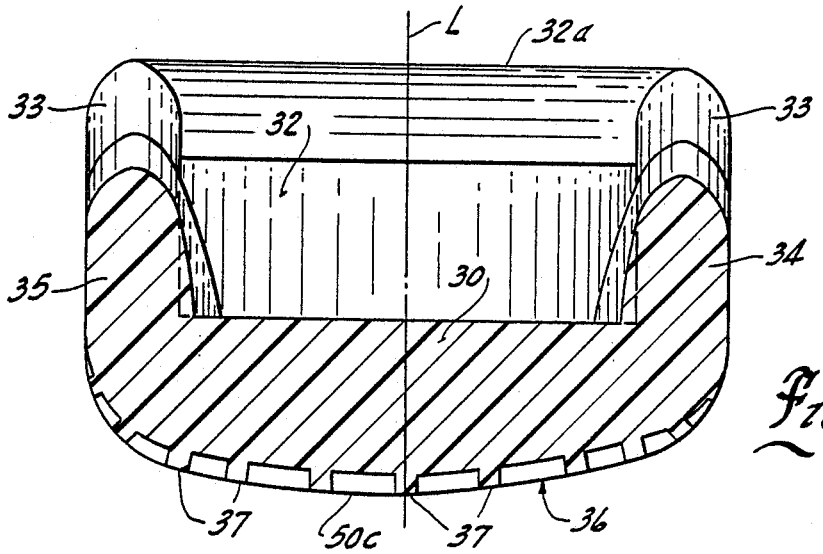
FIG. 7 is a cross-sectional view taken along lines 7—7 of FIG. 3.
Figure 8:
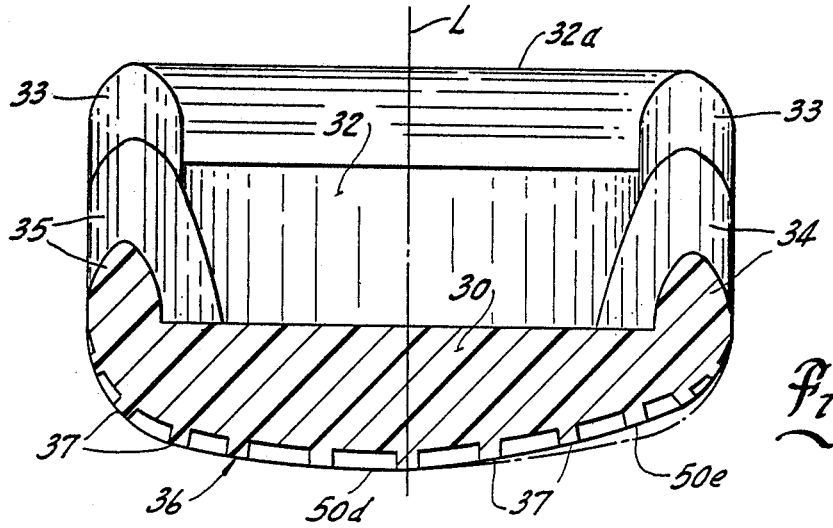
FIG. 8 is a cross-sectional view taken along lines 8—8 of FIG. 3.
Figure 9:
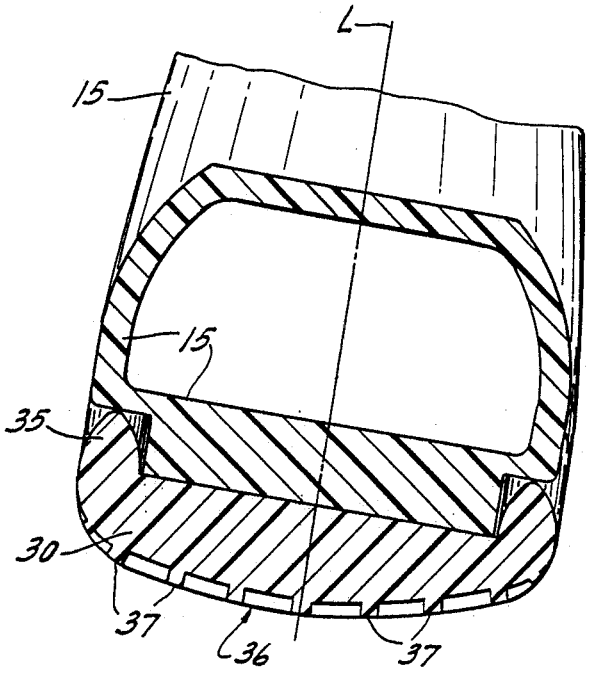
FIG. 9, taken along the line 9—9 of FIG. 2, is a cross-sectional view showing the medially directed perpendicular movement of the boot.

With reference to cross-sectional views of FIGS. 6–8, inclusive, it will be apparent that the roll point 50*b* approximates the cross section taken at FIG. 6 corresponding to the lines 6—6 of FIG. 3. The cross section of FIG. 7 approximates the surface, with a slight divergence between roll points 50*c* and 50*d*. The FIG. 8 cross section, in contrast, presents skewed or canted roll point 50*e* tapering in this case, from the longitudinal axis L (FIG. 8) forwardly towards the medial side surface 34 of the attachment 30. Continuation of roll point 50*d* is illustrated to be a substantially identical mirror- image on either side of the longitudinal axis L between the medial surface 34 and the lateral surface 35 of the attachment 30. The cross sectional views of FIGS. 6 and 7 also present bottom surface areas 50*b* and 50*c* which are substantially symmetrical at either side of the axis L, except for the slight cant shown in dotted lines in these FIGURES.

Thus, with reference to the foregoing explanation of the mechanics of the normal walking foot, it will be observed that the roll points or areas 50*a*–50*e* correspond to usual placement of the heel 51*a*, corresponding to roll point 50*a*, to lifting of the heel 51*a* from the momentary standing phase, as the body center passes the midpoint supported by the area defined between the roll points 50*b* and 50*c*, corresponding to the points 51*b* and 51*c* defining the arch of the foot 41. The area defined between roll points 50*d* and 50*e* causes the foot 41 to take its natural course towards the medial, and with the last roll point, 50*e*, corresponding with the digit point 51*e* at the end of the great toe to provide "push off" for transmitting the body weight to the heel of the opposite foot as it contacts ground.

Figure 12:
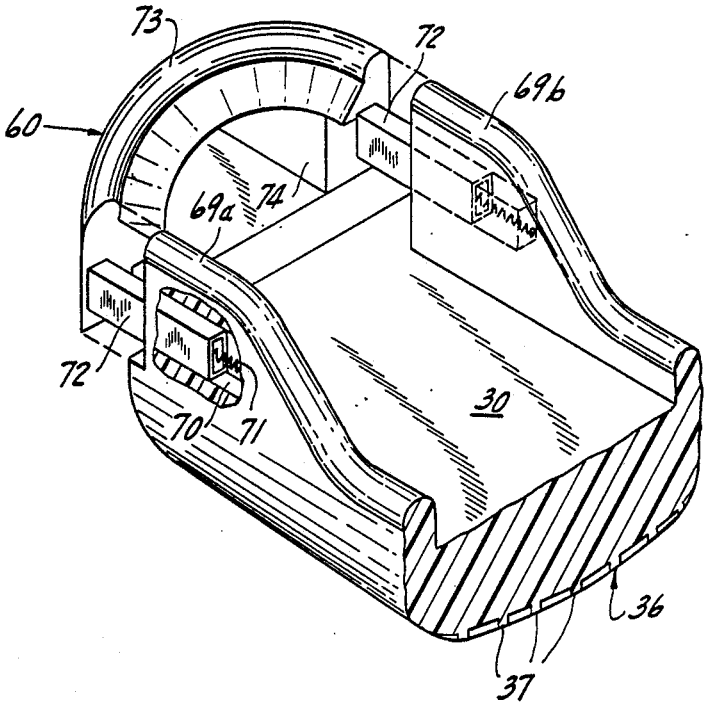
FIG. 12 is a perspective view illustrating another embodiment of a clamping means which may be utilized for attaching the sole attachment to a conventional ski boot.

FIG. 12 is representative of additional means for fastening the sole attachment 30 to the ski boot 15. Here, a mechanically operated heel securing assembly 60 is provided on the attachment 30. The embodiment of FIG. 12 includes oppositely disposed trunnions 69*a* and 69*b*, each having a re-entrant bore 70 containing a tension spring 71, normally in the compressed state, but shown in FIG. 12 as stretched to oppose the outward lateral motion of the slidable support element 72 received by the re-entrant bore 70 in each trunnion 69*a* and 69*b*, respectively. The outer ends of each element 72, respectively, are attached to a longitudinally movable heel piece 73. The heel piece 73 is provided with a recessed portion 74 not unlike the recess 32 in the embodiment of FIGS. 1–10, respectively.

Thus, the insertion of a boot (not shown in FIG. 12) and its rear projection 32 engaging the recess 74 of the heel member 73 will cause separation of the heel piece 73 to the extended position shown in FIG. 12, thereby permitting insertion of the front projection 17 of the boot 15 within recess 31 (not shown), to provide a means of securement of the attachment 30 to the boot 15. This arrangement permits the attachment 30 to remain on the boot 15 even under the most adverse ground walking conditions.

Although, as shown in detail herein, the attachment 30 may be provided to stretch to fit several sizes of ski boots or other footwear, either by inherent elastomeric properties of the molded urethane or by the movable heel securing device 60 of FIG. 12, it is preferable to correlate the size of the ski boot with the size of the attachment. Trying to employ an attachment created for a size 9 boot for a size 12 boot tends to violate the criteria of anatomical correctness, kinetic proportionality, roll points and vector fields with medial resultants which have been discussed above.

It will be apparent that the present invention has provided an attachment for conventional ski boots having a relatively flat or plantar surface designed for skiing, while at the same time providing a means for re-establishing a near normal walking gait which is prevented by the deliberately vertically canted, relatively rigid construction of the boot.

The present invention further contemplates and anticipates the application of the "roll point" or area configuration to devices or attachments accommodating the bottom or plantar surfaces of foot gear, such as conventional, relatively rigidly constructed "boots" or design and development of other appliances prescribed for retaining an injured foot. Such appliances are often used in the case of supporting a sprained foot or ankle. It has been found that the present "roll point" area design comfortably re-establishes the normal walking gait to the injured person. By emulating the "path of resultants" of the normal foot, substantial relief is attained and provides additional means for alleviating pain and suffering during convalescense of an injured ankle or foot otherwise rigidly retained in the orthopedic appliance or "boot". Such appliance is not specifically shown in the drawings, but will be apparent to one skilled in the art upon even a cursory review of the various drawings appended hereto.

What is claimed is:

1. A sole or plantar surface configuration for footwear that has been deliberately configured to retain a foot in a substantially rigid and inflexible manner but which interferes with a normal walking gait, said surface configuration serving to facilitate walking and including opposed forward and rearward ends and at least one roll point area spaced rearwardly from the forward end thereof, said one roll point area lying in a plane angularly disposed relative to the longitudinal axis of the planar surface and in a direction towards the medial surface of the footwear, wherein the plantar surface configuration is canted angularly relative to the vertical axis for a portion of its length and in the proximity of the forward end thereof.

2. The footwear surface configuration of claim 1, wherein the surface contains additional roll point areas longitudinally spaced from said one roll point area and, respectively lying in planes substantially normal to the longitudinal axis of said plantar surface.

3. The footwear surface configuration of claim 1, wherein the surface contains the said one roll point area and additional longitudinally spaced roll point areas disposed substantially normal to the longitudinal axis of said plantar surface, said additional areas comprising a heel and a toe area respectively proximate to the said forward and rearward ends of said surface, and a pair of roll point areas disposed intermediate said heel roll point area and said one roll point area and approximating the longitudinal dimension defining the arched area of the human foot.

4. The footwear surface configuration of claim 1, wherein the plantar surface is further provided with surface tread means for minimizing slippage forwardly and sidewardly during walking.

5. The footwear surface configuration of claim 4, wherein the surface tread means extends upwardly from said bottom surface on at least one side of said support member.

6. The footwear configuration of claim 5, wherein the surface tread means extends upwardly from the bottom surface at both sides of said support member.

7. The footwear surface configuration of claim 1, wherein the plantar surface configuration is canted angularly relative to the vertical axis of said footwear.

8. The footwear surface configuration of claim 7, wherein the forward portion of said footwear surface length is canted at a larger angle relative to the vertical than the remaining vertically canted portion.

9. A sole attachment for footwear having a footwear sole and being deliberately configured to retain a foot in a rigid and inflexible manner which interferes with a normal walking gait, said attachment serving to facilitate walking, and comprising:

an integrally formed support member having oppositely spaced forward and rearward ends and an upper surface intended to be applied in facing relationship with the footwear sole;

releasable fastening means for securing the support member to the footwear;

lateral support means engagable with said footwear at either side thereof to thereby minimize relative movement between said footwear and said attachment;

the support member including a bottom or plantar surface having a surface configuration including at least one roll point area space rearwardly from the forward end thereof, said one roll point area lying in a plane angularly disposed relative to the longitudinal axis of said plantar surface and in a direction towards the medial surface of the attachment and footwear, wherein the plantar surface is canted angularly relative to the vertical axis for a portion of its length and in the proximity of the forward end thereof.

10. The sole attachment of claim 9, wherein the bottom surface configuration contains additional roll point areas longitudinally spaced from said one roll point area and, respectively lying in planes substantially normal to the longitudinal axis of said plantar surface.

11. The sole attachment of claim 10, wherein the bottom surface configuration contains the said one roll point area and additional longitudinally spaced roll point areas disposed substantially normal to the longitudinal axis of said plantar surface, said additional areas comprising a heel and a toe area respectively proximate to the said forward and rearward ends of said surface, and a pair of roll point areas disposed intermediate said heel roll point area and said one roll point area and approximating the longitudinal dimension defining the arched area of the human foot.

12. The sole attachment of claim 9, wherein the bottom surface configuration is further provided with surface tread means for minimizing slippage forwardly and sidewardly during walking.

13. The sole attachment of claim 12, wherein the surface tread means extends upwardly from said bottom surface and at least one side of said support member.

14. The sole attachment of claim 13, wherein the surface tread means extends upwardly from the bottom surface at both sides of said support member.

15. The sole attachment of claim 12, wherein the plantar surface configuration is canted angularly relative to the vertical axis of said footwear and for substantially the entire length thereof.

16. The sole attachment of claim 15 wherein the forward portion of said footwear surface length is canted at a larger angle relative to the vertical than the remaining vertically canted portion.

17. The sole attachment of claim 7 wherein the releasable fastening means comprises recessed areas defined by upstanding forward and rearward integral wall portions of said attachment and arranged to receive respective projecting end portions of said footwear sole, the said end walls being of elastomeric material adapted to be temporarily distended for receipt of the said footwear sole projections.

18. The sole attachment of claim 9, wherein the releasable fastening means comprises a longitudinally extensible heel piece arranged to receive a rearward end projection of said footwear sole, and defining a pair of forwardly extending support arms, a pair of oppositely disposed stationary trunnions having longitudinal bores for receiving the respective arms, and biasing means associated with said arms and said trunnions arranged to normally bias said arms and said heel piece forwardly relative to said footwear sole.

19. A sole for footwear which is deliberately configured to retain a foot in a rigid and inflexible manner which interferes with a normal walking gait, said sole serving to facilitate walking, and comprising:

an integrally formed body having oppositely spaced forward and rearward ends and an upper surface intended to be applied in facing relationship with the footwear;

said body also including lateral support means engagable with said footwear at either side thereof to minimize relative movement between said footwear and said sole;

the sole further including a bottom or plantar surface having a surface configuration including at least one roll point area spaced rearwardly from the forward end thereof, said one roll point area lying in a plane angularly disposed relative to the longitudinal axis of said plantar surface and in a direction towards the medial surface of the footwear, wherein the plantar surface is canted angularly relative to the vertical axis for a portion of its length and in the proximity of the forward end thereof.

20. The sole of claim 19, wherein the bottom surface configuration contains additional roll point areas longitudinally spaced from said one roll point area and, respectively lying in planes substantially normal to the longitudinal axis of said plantar surface.

21. The sole of claim 19, wherein the bottom surface configuration contains the said one roll point area and additional longitudinally spaced roll point areas disposed substantially normal to the longitudinal axis of said plantar surface, said additional areas comprising a heel and a toe area respectively proximate to the said forward and rearward ends of said surface, and a pair of roll point areas disposed intermediate said heel roll point area and said one roll point area and approximating the longitudinal dimension defining the arched area of the human foot.

22. The sole of claim 19, wherein the bottom surface configuration is further provided with surface tread means for minimizing slippage forwardly and sidewardly during walking.

23. The sole of claim 19, wherein the surface tread means extends upwardly from the bottom surface on at least one side of said body.

24. The sole of claim 19, wherein the surface tread means extends upwardly from the bottom surface at both sides of said body.

25. The sole of claim 19, wherein the releasable fastening means recessed areas is defined by upstanding forward and rearward integral wall portions of said sole arranged to receive respective projecting end portions of said footwear, the said end walls being of elastomeric material adapted to be temporarily distended for receipt of the said footwear projections.

26. The sole of claim 19, wherein the releasable fastening means comprises a longitudinally extensible heel piece arranged to receive a rearward end projection of said footwear, and defining a pair of forwardly extending support arms, a pair of oppositely disposed stationary trunnions having longitudinal bores for receiving the respective arms, and biasing means associated with said arms and said trunnions arranged to normally bias said arms and said heel piece forwardly relative to said footwear sole.

27. The sole of claim 22, wherein the surface tread means extends upwardly from said bottom surface and at least one side of said support member.

28. The sole of claim 22, wherein the surface tread means extends upwardly from the bottom surface at both sides of said support member.

29. The sole of claim 9, wherein the plantar surface configuration is canted angularly relative to the vertical axis of said footwear and for substantially the entire length thereof.

30. The sole of claim 19, wherein said body at the forward portion of said footwear surface length is canted at a larger angle relative to the vertical than the remaining vertically canted portion.

31. An attachment for the sole of footwear which has been deliberately configured to retain a foot in a substantially rigid and inflexible manner, said footwear interfering with a normal walking gait, said attachment having a plantar surface configuration serving to facilitate walking and including opposed forward and rearward ends, said plantar surface being arched upwardly along its longitudinal axis and towards both the rearward and forward ends and being arched upwards and perpendicularly from its longitudinal axis to create marginal edges which extend at least partially around the sole of said footwear, wherein the plantar surface configuration is canted angularly relative to the vertical axis for a portion of its length and in the proximity of the forward end thereof.

32. The attachment of claim 22, wherein said marginal edges are further provided with tread means.

33. The attachment of claim 32, wherein said attachment has a greater thickness in the area where said longitudinal arch extends toward said forward end than the thickness in the area where said longitudinal arch extends toward said rearward end.

* * * * *